US005284027A

United States Patent [19]

Martin, Sr.

[11] Patent Number: 5,284,027

[45] Date of Patent: Feb. 8, 1994

[54] AIR CONDITIONING SYSTEMS

[76] Inventor: Lendell Martin, Sr., 7037 Brittmoore, Houston, Tex. 77041

[21] Appl. No.: 971,524

[22] Filed: Nov. 3, 1992

Related U.S. Application Data

[63] Continuation-in-part of Ser. No. 787,392, Nov. 4, 1991, abandoned, which is a continuation-in-part of Ser. No. 606,896, Oct. 31, 1990, Pat. No. 5,062,280.

[51] Int. Cl.[5] ..... F25D 21/14

[52] U.S. Cl. ..... 62/291; 62/298; 165/126

[58] Field of Search ..... 62/291, 285, 288, 298; 165/124, 126; 237/50, 53; 285/424

[56] References Cited

U.S. PATENT DOCUMENTS 3,910,061 10/1975 Irwin ..... 62/291 X 4,658,602 4/1987 Giberson et al. ..... 62/291 X 4,671,076 6/1987 Duren ..... 62/291 X

FOREIGN PATENT DOCUMENTS 632003 11/1949 United Kingdom ..... 62/291

*Primary Examiner*—William E. Tapolcai

*Attorney, Agent, or Firm*—Guy McClung

[57] ABSTRACT

A drain pan with an opening or openings through which air flows to a coil and a coil which, in one embodiment, has a cover plate so air flowing through a drain pan flows between vanes of a coil rather than out from an opening at an end of the coil; such a pan in combination with such a coil; and a system with such a coil-pan combination which uses a single pan for multiple orientations of the coil-pan combination in both horizontal flow, up-flow, and down-flow systems.

8 Claims, 8 Drawing Sheets

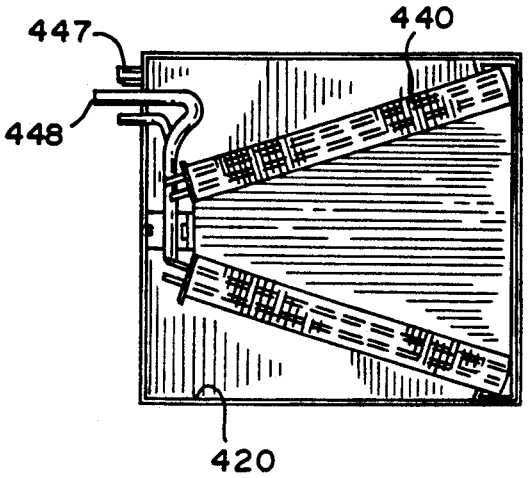
FIG. 14
FIG. 15
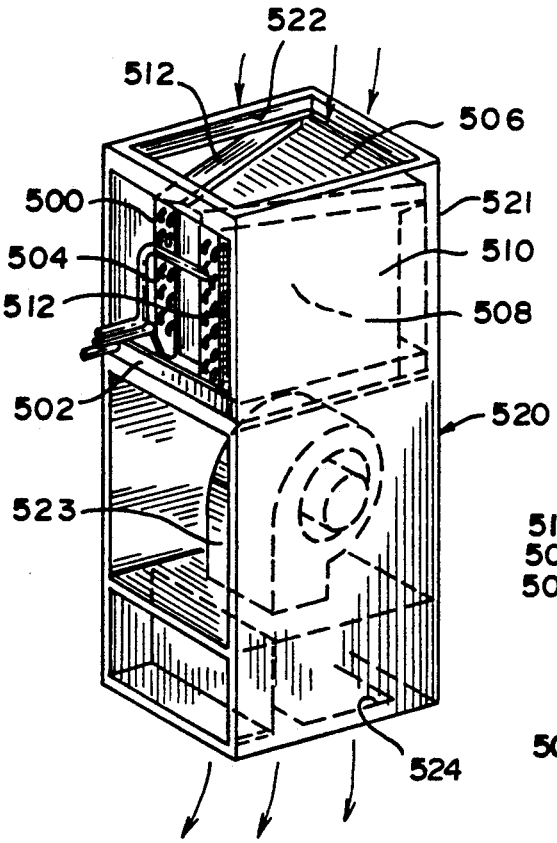
FIG. 16
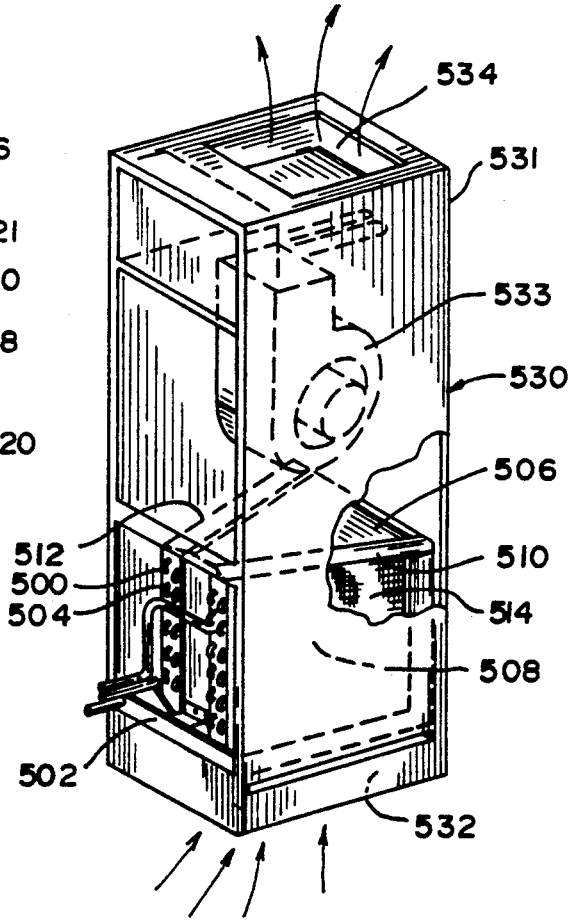

AIR CONDITIONING SYSTEMS

RELATED APPLICATION

This is a continuation-in-part of pending U.S. application Ser. No. 07/787,392 filed on Nov. 4, 1991 entitled "Air Conditioning System And Components Thereof," now abandoned, which was a continuation-in-part of Ser. No. 606,896 filed Oct. 31, 1990 now U.S. Pat. No. 5,062,280 issued Nov. 5, 1991.

BACKGROUND OF THE INVENTION

1. Field Of The Invention

This invention is related to air conditioning systems and apparatuses, e.g. for heating or cooling air; in one aspect to such apparatuses with a coil in a plenum box; and in another aspect to an M-configured coil and drain pan for it; and in certain aspects to drain pans through which air flows to a coil.

2. Description of Related Art

By Jan. 1, 1992 U.S. federal regulations will require that certain air conditioning units have a seasonal energy efficiency ratio of at least 10.0. A variety of efforts have been made to develop systems which can satisfy this standard.

It is known in the art of air conditioning coil design that the efficiency of an air conditioning system can be increased by increasing the face area of a coil and by decreasing the number of tubing rows, thus decreasing the static pressure necessary to flow air through the coil. Prior art efforts at expanding the face area of a coil have resulted in a larger coil as far as overall length and width are concerned.

Coils are installed in housings, many of which are sized to meet common industry requirements. Also, in many buildings, the space allotted for installation of a housing with a coil therein is space in a closet or interior area which is limited by walls and ceilings. Consequently, enlarged coils (coils made larger to expand face area to increase system efficiency) either do not fit in the space typically made available for a coil; or the space itself must be increased to accommodate the larger coil. enlarging the space is often complicated, requiring the removal of existing walls or ceiling, rerouting of electrical and other conduits, and alteration of existing system housings and enclosures.

Limitations on the manner in which coils can be oriented limits the ways in which existing housings, enclosures, and spaces can be altered to accommodate an enlarged coil. Coil orientation is also limited by available drain pan design.

In various prior art air conditioning systems the blower of a furnace is used to propel air through a transition member connected to the furnace, through a coil, and into a plenum box. Through various openings in the plenum box air exits into conduits which carry it to various locations.

These prior art systems are relatively complex since they require a transition member and also the various connections between the transition member and the coil housing and between the coil housing and the plenum box. These systems are inefficient since the air moves from the coil in one direction, hits the interior of the plenum box, changes direction, and then exits, often after multiple encounters with the plenum's interior. The dimensions of the transition member and the dimensions of the connecting members often depend on the size of the coil that is used; so that even if several locations have an identical blower, different transition members, etc. may be required.

In accordance with 37 C.F.R. §1.56, the following are disclosed:

"Ruud Electric Furnaces," Ruud Air Conditioning Division, 1988.

"Cased Horizontal Furnace Coils Model 519E," Payne Air Conditioning, April, 1990.

"Ruud Indoor Coils," Ruud Air Conditioning Division, 1989.

"Cased Horizontal Furnace Coils," Payne Air Conditioning, 1990.

U.S. Pat. No. 2,022,523 discloses an air conditioning apparatus with a blower in an enclosure and a U-shaped duct with a discharge opening. Both heat exchange elements and cooling coils are disposed in the U-shaped duct.

U.S. Pat. No. 3,372,870 discloses an air treating assembly which includes a condensing unit, exhaust and air intake assembly, a filter, a blower assembly, a heater, a cooling coil and a mixing damper assembly.

U.S. Pat. No. 3,405,758 discloses an air mixing apparatus for controlling air flow in a duct, having blowers that blow air through a heating unit and through a cooling unit.

U.S. Pat. No. 3,411,569 discloses a combined heating-cooling unit.

U.S. Pat. No. 3,464,487 discloses an air handling unit with a housing enclosing blowers, a heating element, and a cooling element.

U.S. Pat. No. 3,540,526 discloses a rooftop air conditioning unit having a blower and evaporator-coil through which air is blown and then flows out from a housing outlet.

U.S. Pat. No. 3,625,022 discloses an air conditioning unit with a blower and coils. Conditioned air is exhausted into a chamber from which air-conveying conduits extend U.S. Pat. No. 4,657,178 discloses an air mixing box for transferring conditioned air.

Certain prior art pan-coil combinations require two separate pans if the pan-coil is to be useful in a plurality of distinct orientations; e.g., one pan receives condensate when the pan-coil is used in a horizontal air flow mode, but then to use that same coil in an air upflow or downward flow mode, a second pan is needed.

There has long been a need for a coil of expanded face area for an air conditioning system which is useful in existing housings, enclosures, and available installation space. There has long been a need for such a coil which is not limited to a single orientation. There has long been a need for a drain pan for such a coil.

There has long been a need for an efficient air conditioning apparatus which utilizes the blower of a gas or electric furnace. There has long been a need for such an apparatus which is simple, easily made, easily installed, and easily accessed. There has long been a need for such an apparatus which efficiently moves cooled air (or heated air) from a plenum box. There has long been a need for such an apparatus that can efficiently accommodate different size, shape, and type coils.

SUMMARY OF THE PRESENT INVENTION

The present invention discloses an M-configured coil, a drain pan for such a coil, and an air conditioning system (cooling or heating) with such a coil and pan. In one embodiment, a coil according to this invention has a plurality of sub-coils disposed adjacent each other and at angles to each other to form a general "M" shape when viewed from the end forming an "M Coil." Liquid flow tubing passing through the sub-coils is interconnected with intercommunicating tubing so that liquid can flow into, through and out of the sub-coils.

When the M-coil is used in an upright disposition, water condensing on the coil flows down to two outward edges of the coil and down to a central edge. To receive this water from all three coil edges and to conduct it away from the coil, the present invention teaches a unique pan (and a system using it) with three sub-pans, one corresponding to each edge of the coil to which condensed water flows. The sub-pans are configured and disposed so that air flows between the sub-pans and to and then through the sub-coils.

In the previously described embodiment of a coil, pan and system according to this invention, the M-coil is used in an upright manner. It is also within the, scope of this invention to dispose the M-coil on its side with air flowing horizontally into the spaces between the legs of the M and horizontally toward the points of the M. This ability to orient the coil for either vertical or horizontal air flow makes it possible to use this coil in either of two general prior art systems, so that one coil design can be used in either prior art configuration. Thus, it is relatively easy to replace either a vertically oriented or horizontally oriented prior art coil with an expanded face area coil according to the present invention.

When the M-coil is used in the horizontal position, condensed water flows down from each sub-coil. To receive this water and conduct it away from the system, a drain pan is provided beneath the sub-coils. An old, prior art pan may be used.

In one embodiment of the present invention, an air conditioning system is provided that has a system enclosure, a blower for blowing air through the enclosure to a coil; an air conditioning coil within the enclosure, the coil having a general M configuration and comprising four sub-coils into, through and from which air conditioning system liquid flows, the four sub-coils comprising two outer sub-coils and two inner sub-coils, the sub-coils disposed at angles to each other and non-parallel so that viewed from an end thereof the coil has a general M configuration, each of the two outer sub-coils secured to one of the inner sub-coils and the two inner sub-coils secured to each other along an edge apart from points of connection to the outer sub-coils, the M-shaped coil having three bases comprised of extending edges of sub-coils; a drain pan for receiving water condensed on and flowing from the coil, the drain pan comprising a body member, an end trough, a plurality of sub-pans mounted to the body member, the sub-pans spaced apart so that air to be conditioned is flowable between the sub-pans; the plurality of sub-pans comprising three sub-pans, one sub-pan extending adjacent and beneath each of the three bases of the M-shaped coil: the three sub-pans intercommunicating with the end trough, water flowing into the three sub-pans then flowing into the end trough; and the end trough having a water drain outlet.

In certain embodiments of this invention, a drain pan is provided with one or more openings through which air may flow. In particular embodiments, such openings may be defined by sub-pans which correspond, e.g., to the edges of sub-coils. By using pans through which air may flow, a typical coil may be used in either a horizontal flow mode or a vertical flow mode without changing pans. In a horizontal flow mode, an oven end of a coil is closed off with a closure plate.

The present invention, in one embodiment, includes an enclosure with an opening for intercommunicating with a blower of a furnace. The blower is used in air conditioning during hotter periods when the furnace is shut off or it is used (e.g. in conjunction with a heat pump) to produce heated air. The enclosure serves as a plenum to which one or more air-carrying conduits are connected and as a housing for a coil or coils (e.g. cooling coils or heating coils). In this way the need for a transition member between the furnace and a coil housing is eliminated and the need for connection of a coil housing to a plenum is also eliminated.

In one embodiment, the enclosure according to the present invention houses a coil with coil vanes disposed so that air passing through them is directed generally toward openings in the enclosure to which are connected the air-carrying conduits. In this way, the air flows more directly into the conduits rather than contacting the plenum's interior before finally exiting from it.

By using the enclosure as a plenum box and as the housing for the coil, a variety of different size, shape, and configuration coils can be used in one enclosure. Thus, for buildings with identical furnaces, but different air conditioning loads, the same enclosure may be employed for coils of different capacity or type. In this way, the need for separate and distinct transition members for plenums and each type of coil is eliminated.

The enclosure itself may have one side for interconnecting with the furnace housing, which side is fashioned so that it can accommodate a variety of furnace housing openings.

In another embodiment the present invention discloses a generally V-shaped coil which has one end thereof closed off with a closure plate through which air does not flow. In another embodiment of the invention, such a coil is used with a pan according to the present invention, the pan having a shaped opening generally corresponding in shape to the V-shape of the coil. It is within the scope of the invention for the pan opening to correspond in shape to any shape of a coil. Such a pan-coil combination can be used without tilting it on its side or otherwise while still only using one pan. Use of such a pan-coil combination also reduces or eliminates undesirable blowing of water away from a pan.

It is, therefore, an object of the present invention to provide new, useful, unique, efficient and nonobvious apparatuses for air conditioning (e.g. cooling or heating).

A further object of the present invention is the provision of new, useful, unique, and nonobvious apparatuses and methods for efficiently moving conditioned air to the outside of an apparatus.

Another object of the present invention is the provision of such apparatuses which can be used with a furnace blower without requiring separate transition members and plenums for each different type of air conditioning cooling coil.

Yet another object of this invention is the provision of such apparatuses in which air is moved efficiently with a minimum of flow obstruction and with a minimum of encounters with the interior of a plenum.

An additional object of the present invention is the provision of such apparatuses which can accommodate a variety of furnaces. .Yet another object of the present invention is the provision of an M-coil with four sub-coils, and an air conditioning-system with such a coil.

A further object of the present invention is the provision of such a coil which can be oriented vertically or horizontally.

An additional object of the present invention is the provision of a drain with sub-pans for catching condensed water flowing from the sub-coils of the M-coil, and a system with such a pan.

A particular object of the present invention is the provision of such a pan with two outer and one central sub-pan for receiving condensed water flowing from the coil when it is vertically oriented.

Another object of the present invention is the provision of a drain pin with spaces between sub-pans through which air may flow to a coil.

A further object of the present invention is the provision of a coil with increased face area which does not restrict air flow as much as prior art coils.

Another object of the present invention is the provision of such coils, pans, or systems which are useful in already existing spaces.

An additional object of the present invention is the provision of a drain pan with an opening or openings therethrough so that air may flow through the openings to a coil mounted on or above the pan; thus, permitting a coil on such a pan to be used in either a vertical flow or a horizontal flow system; and a pan-coil combination using such a pan, and such a pan-coil combination which requires only one pan for multiple air flow modes and for different system enclosures.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages objects of the invention, as well as others which will become clear, are attained and can be understood in detail, more particular description of the invention briefly summarized above may be had by reference to certain embodiments thereof which are illustrated in the appended drawings,, which drawings form a part of this specification. It is to be noted, however, that the appended drawings illustrate preferred embodiments of the invention and are therefore not to be considered limiting of its scope, for the invention may admit to other equally effective equivalent embodiments.

FIG. 14 is a top view of the pan and coil shown in FIG. 13.

FIGS. 15–18 are schematic views of systems according to the present invention with certain components according to the present invention.

DESCRIPTION OF EMBODIMENTS PREFERRED AT THE TIME OF PILING FOR THIS PATENT

Figure 1:
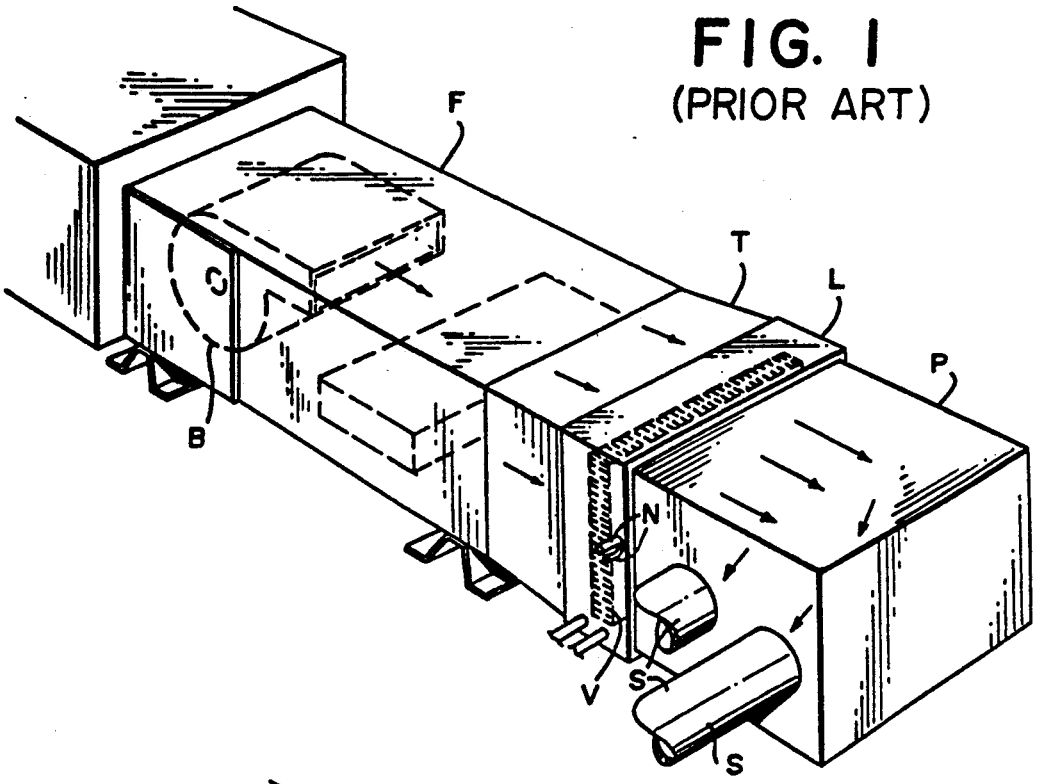
FIG. 1 (PRIOR ART)
FIG. 1 is a schematic view of a prior art air conditioning apparatus.

Referring now to FIG. 1 a typical prior art apparatus is shown schematically. A blower B in a furnace housing F propels air into a transition member T which is interconnected between the housing F and a housing L of an air conditioning coil C. The air moves through the vanes V of the coil C, exiting the housing L and moving into a plenum box P. Some of the air (as shown by the arrows) encounters the interior walls of the plenum P. Air exits the plenum P into various conduits S which carry the conditioned air to locations as desired. Cooling fluid flows through connections N of the coil C.

Figure 2:
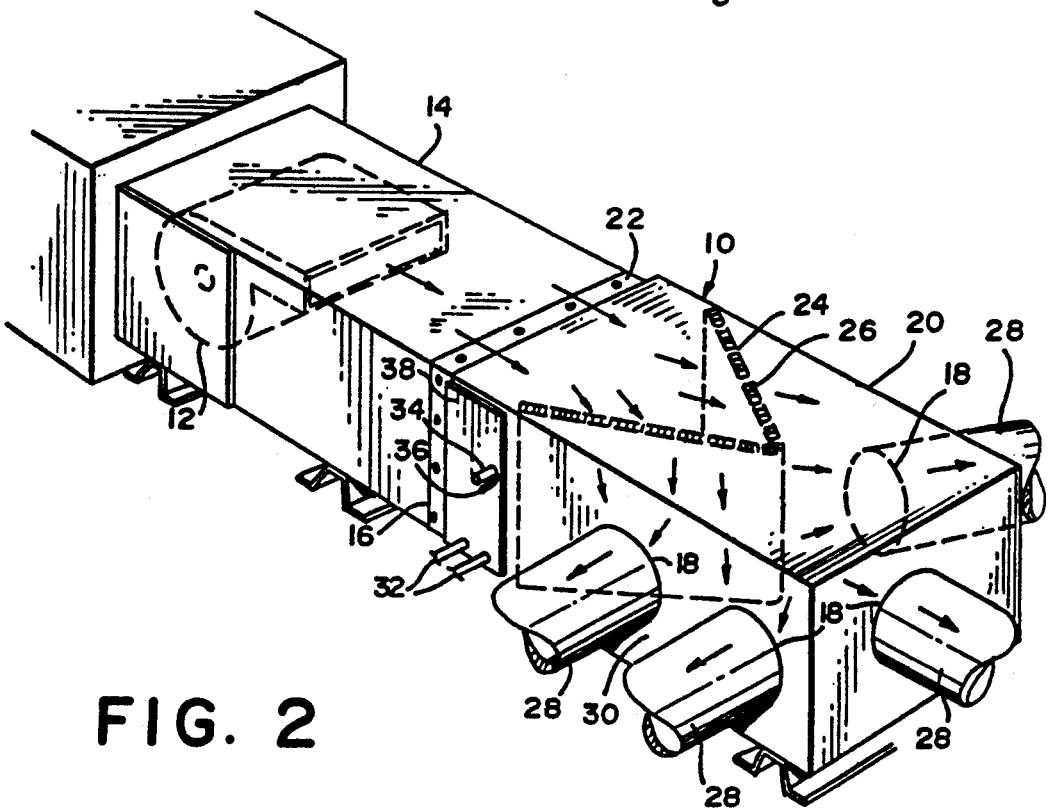
FIG. 2 is a schematic view of an air conditioning apparatus according to the present invention.

As shown in FIG. 2, an apparatus 10 according to the present invention includes a blower 12 of a furnace in a furnace housing 14. The furnace housing 14 has an opening 16 which communicates with an enclosure 20 via a connection member 22. A coil 24 is disposed in the enclosure 20. A service door 38 permits access to the interior of the enclosure 20.

Air is moved by the blower 12 from the furnace housing 14 and then through vanes 26 of the coil 24. The coil can be a cooling coil that cools the air (or a heating coil for heating the air if no furnace element is present or if it is desired to augment the heating of a furnace element that is present). The cooled air flows from the coil into the interior of the enclosure 20 and then into conduits 28 connected to openings 18 in the enclosure 20. As shown, the vanes 26 are oriented so that some of the air moving between them is redirected in the direction Of the openings 18. A pan 30 is disposed beneath the coil 24 and liquid drains from the pan out of drain nipples 32.

Figure 3:
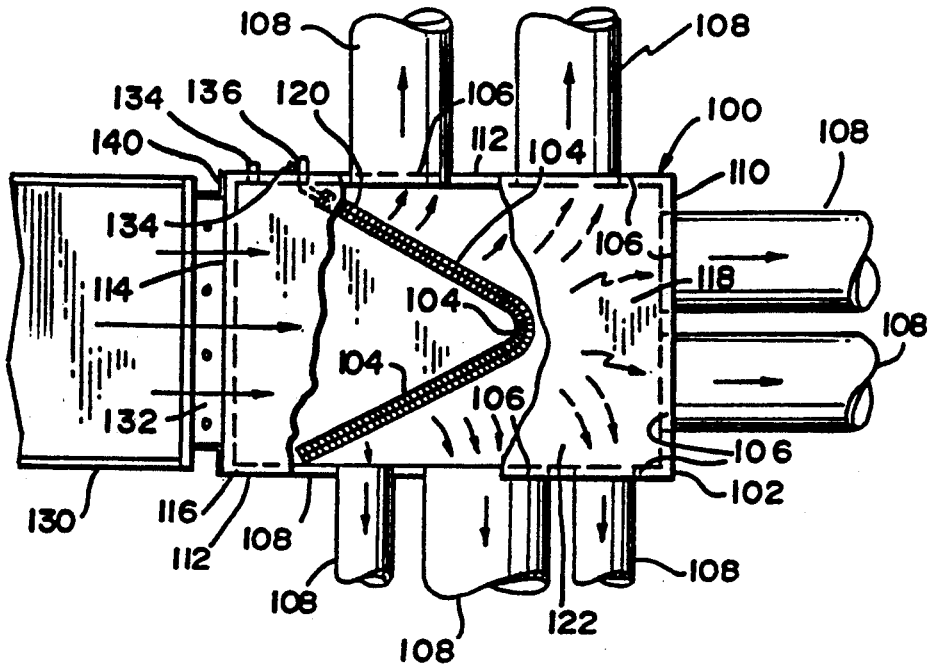
FIG. 3 is a top view of an apparatus according to the present invention.

Referring now to FIG. 3, an apparatus 100 according to the present invention has an enclosure 102 including a top wall (not shown), a bottom wall 106 and side walls 110, 112, 114 and 116. A coil 120 is mounted within the enclosure 102 and a drip pan 122 is disposed in the enclosure beneath the coil 120.

Each side wall is made with metal bracing (see FIG. 4) to which is connected an insulating material such as duct board. Holes can be cut in the duct board as desired to provide openings leading to air-carrying conduits. Cooling fluid flows through connections 136 on the coil 120. According to this invention, it is preferred that coils are used with Vanes oriented to project air from the coils in the direction of air-carrying conduit openings for greater air conveying efficiency. Vanes 104 of the coil 120 are oriented so that air leaving the coil is heading toward openings 106 to which are connected various ducts 108. A pan 118 extends over the entire bottom of the enclosure 102. This is useful when coils of different size or configuration are to be installed in one enclosure. Liquid drains from the pan 118 out through drain nipples 134. By providing a pant that covers the entire piece of duct board that forms the bottom wall of the enclosure, dripping from any size coil is caught and transferred out from the enclosure. An enclosure according to this invention may house different coils (although an enclosure would not usually have multiple coils; but this is not beyond the scope of this invention). For example, two V-shaped coils may be used, on adjacent to the other.

A connection member 140 connected to the side wall 14 provides a convenient interface for the apparatus 100 and a furnace blower housing 130. The connection member 140 is made from metal bracing 132 and is easily affixed to the bracing of the wall 114 with sheet metal screws.

Figure 4:
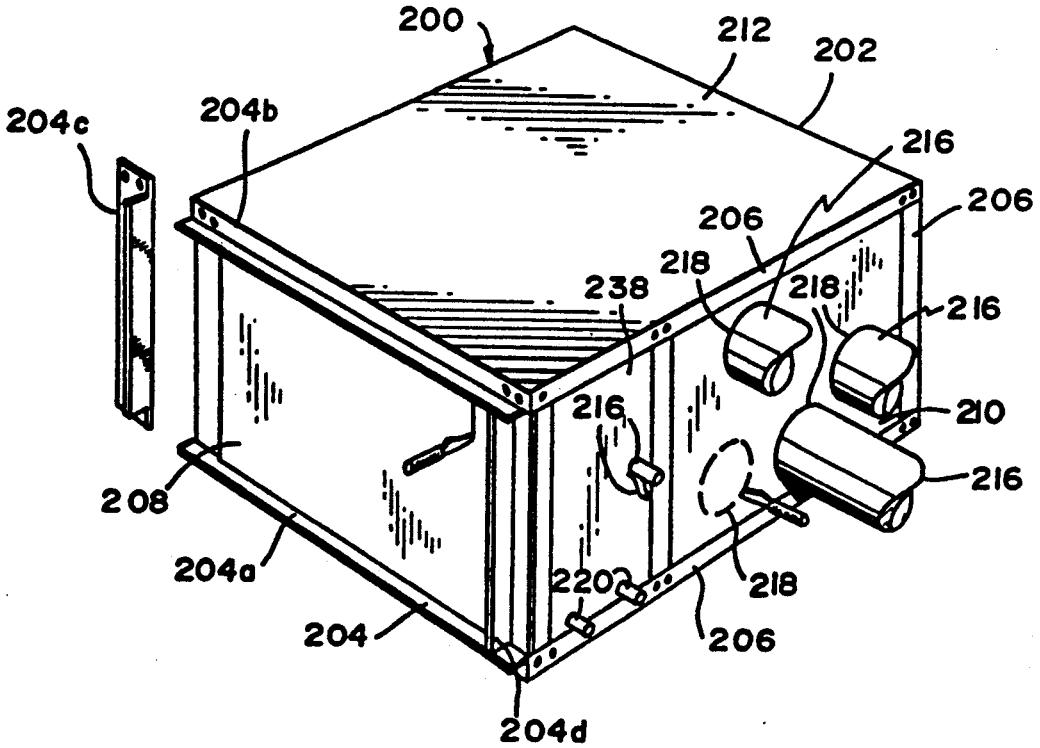
FIG. 4 is a perspective view of an apparatus according to the present invention.

Referring now to FIG. 4, an apparatus 200 according to the present invention has an enclosure 202 (like the enclosure 102 of FIG. 3). FIG. 4 illustrates how an enclosure 202 according to this invention may have a connection member 204 (like members 22, FIG. 2 and 140, FIG. 3) sized to accommodate an opening in a blower or furnace housing. The connection member 204 includes four pieces of metal bracing 204*a*, 204*b*, 204*c*, and 204*d*. The pieces 204*c* and 204*d* may be positioned as desired to mate with another housing's opening. Also, the pieces 204*a* and 204*b* could be moved to accommodate such an opening. The pieces are secured to bracing 206 which forms a cubic skeleton for the enclosure 202, e.g. with metal screws. For ease of construction, an opening of appropriate size is cut in a side wall 208 of the enclosure 202 before the pieces of the connection-member 204 are installed. It is preferred that sidewalls, e.g. walls 208 and 210, and the other walls be made from an insulative material such as duct board and that a metal top 212 cover the top duct board wall. A drain pan, not shown, within the enclosure 202 sits on top of a bottom duct board wall and liquid drains out through drain nipples 220. By using duct board, holes 218 can easily be cut as desired for connecting air-conveying conduits 216 to the enclosure 202. Service door 238 is like service door 38, FIG. 1 connections 136 are like connection 136, FIG. 3. The bottom duct board wall, not shown, has an underlaying metal bottom, not shown, like the metal top 212.

Figure 6:
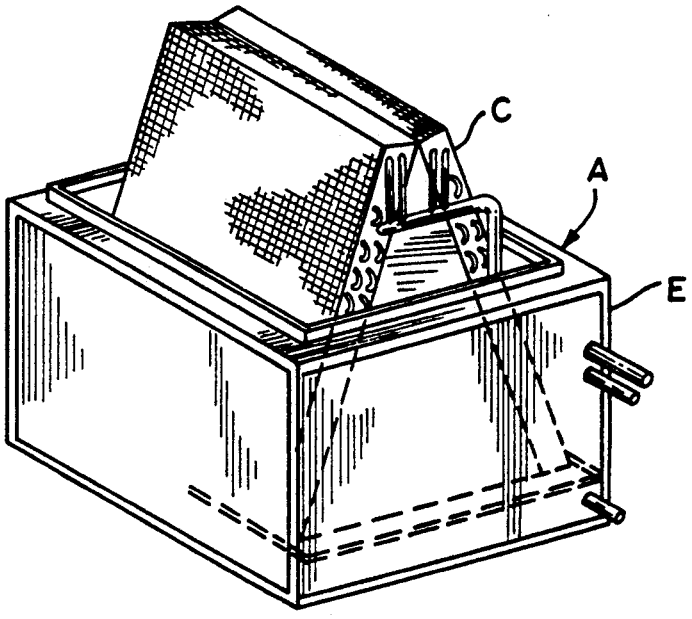
FIG. 6 (PRIOR ART)
FIG. 6 is a perspective view of a prior art apparatus.

Referring now to FIG. 6, a prior art system A is shown with a coil c partially disclosed in an enclosure E. Part of the coil C protrudes from the enclosure E, there the coil C is more efficient than a smaller V-shaped coil which could fit entirely within the enclosure E.

Figure 5:
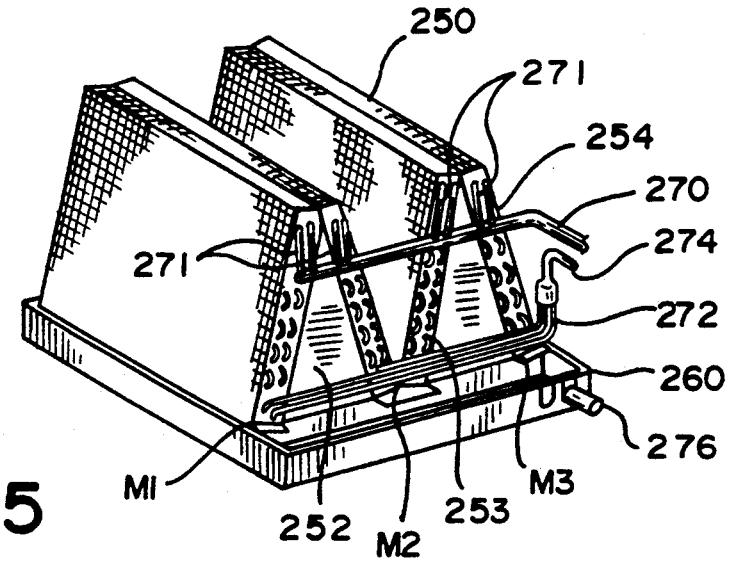
FIG. 5 is a perspective view of an M-coil and pan according to the present invention in an upright configuration.

Referring now to FIG. 5, a coil 250 according to the present invention is supported in a drain pan 260 according to the present invention. The coil 250 is comprised of four connected sub-coils 251, 252, 253, and 254 which are secured together so that when viewed from the end as shown in FIG. 5, they form a general M-shape with three bases M1, M2, and M3 formed respectively by extending bottom portions of the sub-coils 251, 252–253, and 254, respectively. The coil 250 may be used in place of the coil shown in FIG. 2.

Air conditioning liquid flows from a main inlet pipe 274 into each sub-coil through sub-inlet pipes 272 and from each sub-coil through an outlet sub-pipe 271 to a main outlet pipe 270. Water condensing on the sub-coils flows down to the pan 260 and out through a nipple 276.

Figure 7:
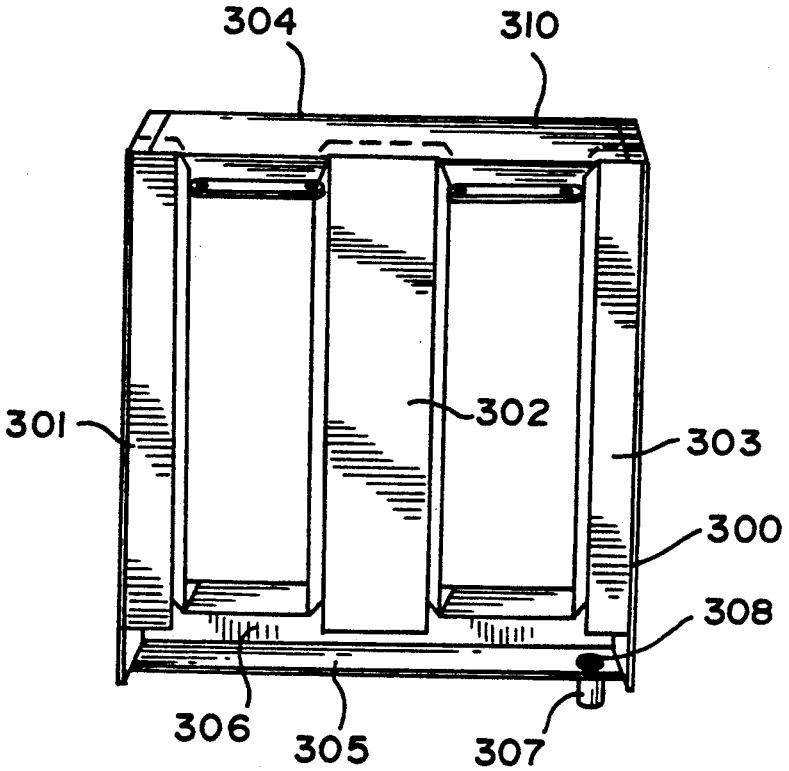
FIG. 7 is a top view of a drain pan according to the present invention.
Figure 8:
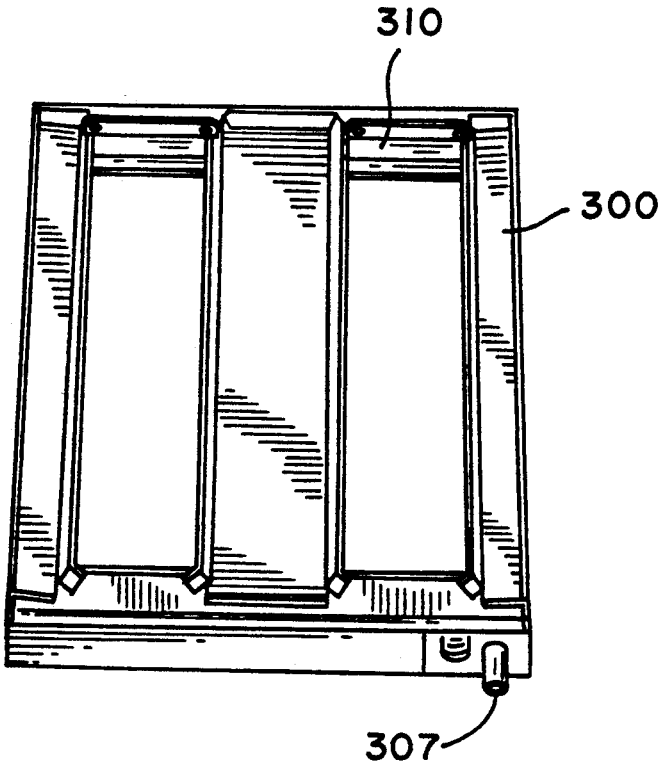
FIG. 8 is a bottom view of the pan of FIG. 7.

Referring now to FIGS. 7 and 8, a drain pan 300 according to the present invention has a body member 310 and three sub-pans 301, 302, and 303 connected thereto. Each of the side sub-pans 301, 302 is tilted so that water flows from an end 304 of the body member to a trough 306 and another end 305 of the body member. One or more drain nipples 307 is mounted in an outlet orifice 308 in a side wall of the trough 306.

Figure 10:
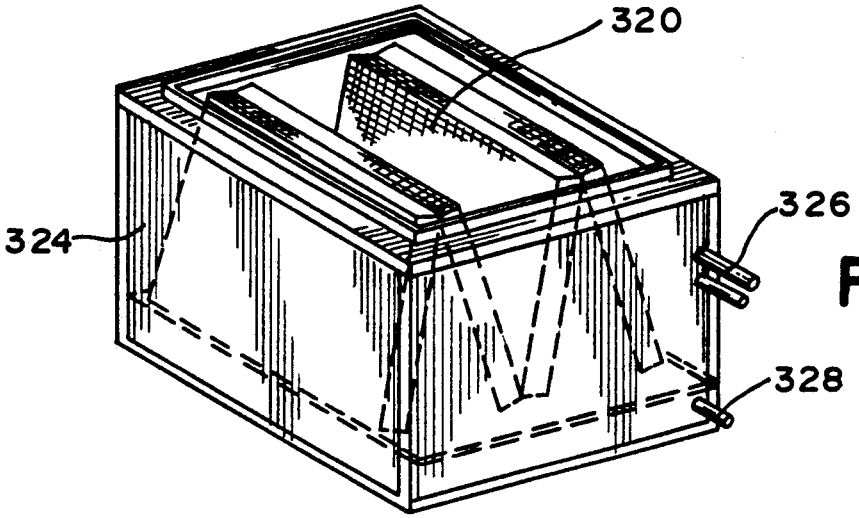
FIG. 10 is a top perspective view of the other end of the apparatus of FIG. 9.
Figure 9:
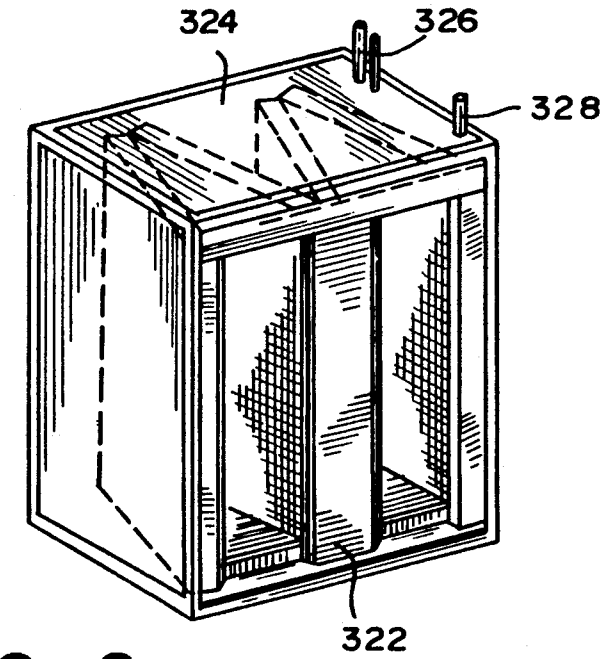
FIG. 9 is an end view of one end of the apparatus shown in FIG. 5 within an enclosure.

FIGS. 9 and 10 illustrate a coil 320 (like the coil 250, FIG. 5) and a drain pan 322 (like the drain pan 300, FIG. 7) disposed in an air conditioning system enclosure 324. Liquid flows into the coil through an inlet 326 and out through an outlet (not shown). Water flows from the pan 322 through a drain nipple 328.

Figure 11:
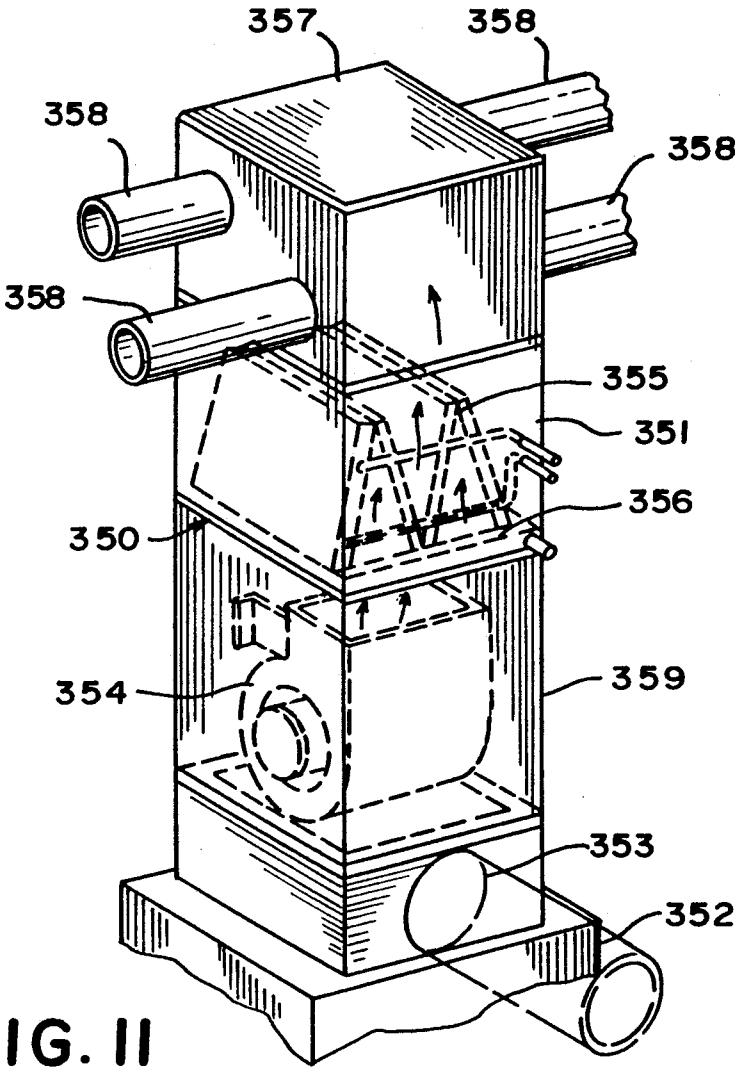
FIG. 11 is a view of a system according to the present invention with a housing shown partially cutaway to reveal an M-coil and pan according to the present invention.

Referring now to FIG. 11, an air conditioning system 350 according to the present invention has a platform or base 352; an air inlet 353 in an enclosure 359; a blower 354; a coil enclosure 351; a coil 355 like the coil shown in FIG. 5; a pan 356 like the pan shown in FIG. 7; a plenum 357; and exit ducts 358.

Figure 12:
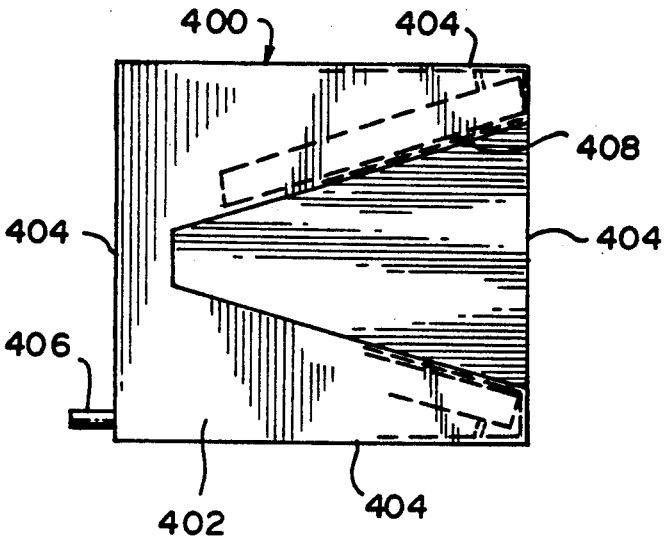
FIG. 12 is a top view of a drain pan according to the present invention.

FIG. 12 shows a drain pan 400 according to the present invention which has a bottom wall 402 and four side walls 404. Water drains from the pan through a drain nipple 406. A V-shaped opening 408 in the bottom of the pan 400 permits air to flow through the pan to a coil (not shown) mounted on the pan.

Figure 13:
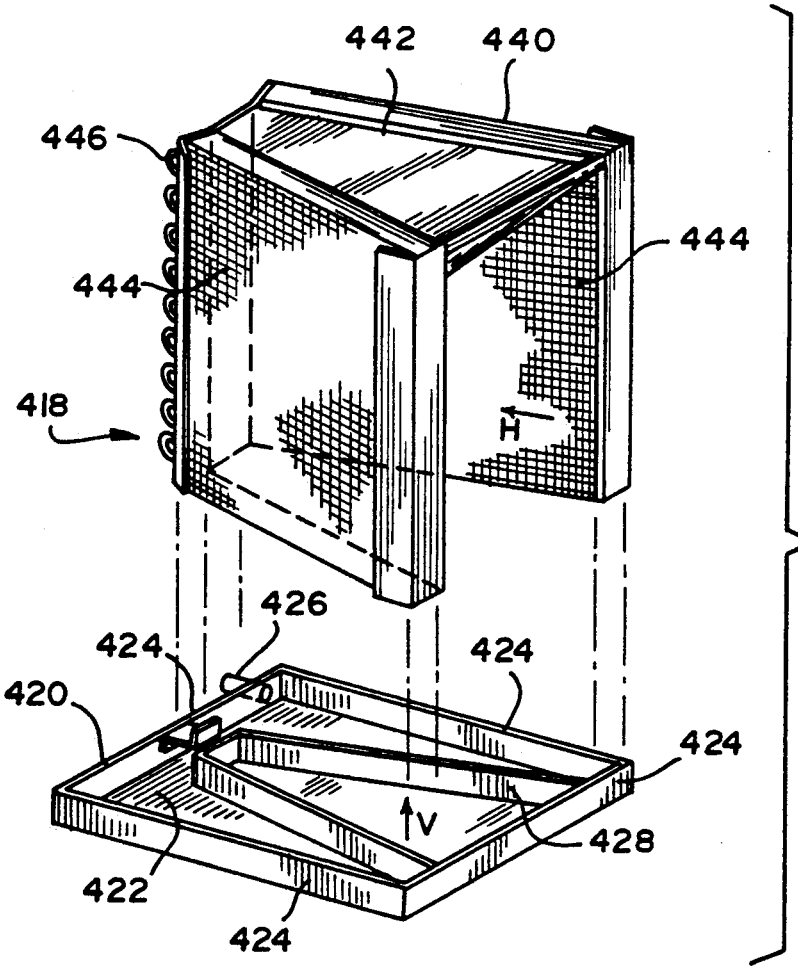
FIG. 13 shows a coil in a drain pan according to the present invention.

As shown in FIGS. 13 and 14, a pan-coil combination 418 according to the present invention includes a drain pan 420 with a bottom wall 422 and four side walls 424. Water drains from a drain nipple 426. Air may flow to a coil 440 through an opening 428 in the bottom wall 422 of the pan. The opening 428 is generally V-shaped to correspond to the general V-shape of the coil 440. When air is flowed vertically to the coil through the opening 428 (arrow V in FIG. 13) a top closure plate 442 is secured on top of the coil 440 so that the air flows to and between a plurality of vanes 444 of the coil 440 rather than out the open top end of the coil. The coil 440 has a plurality of liquid flow tubes 446 (one shown in outline) and a liquid inlet 447 and outlet 448. When the pan-coil combination 418 is used with air flowing in horizontally to the coil 440 (arrow H in FIG. 14), either the pan-coil combination will fit tightly in an enclosure closing off both ends of the coil so air must flow out between the vanes, or a closure plate can be used on the top and/or the bottom to close off the end(s).

Figure 19:
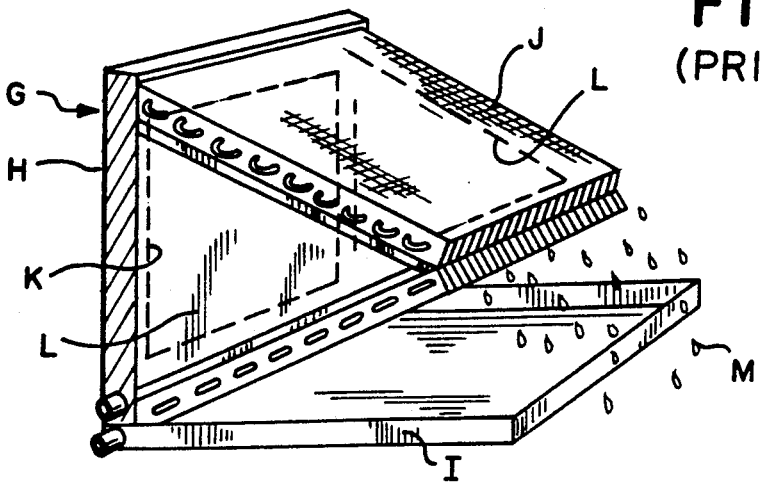
FIG. 19 (PRIOR ART)
FIG. 19 shows a prior art pan-coil combination.

FIG. 19 shows a prior art two-pan coil combination G with a first pan H, a second pan I and a coil J. In the orientation shown the combination G has the coil J tilted sideways and the pan I is disposed for receiving water dripping from the coil J; however, as shown some of the water M is blown and misses the pan. Air flows to the coil J through an opening K in the pan H. In a vertical orientation of the coil J, the pan H is disposed to receive water dripping from the coil J. Both ends of the coil J are blocked off by closure plates L. In order to use the coil J in both the sideways orientation shown in FIG. 19 and in a vertical orientation, not shown, tho two pans H and I are required.

FIGS. 15, 16, 17, and 18 illustrate four different coil orientations that are possible with a coil-pan combination as shown in FIGS. 13 and 14. Each of the four possible coil-pan orientations is achieved with a single pan and with the same coil-pan combination; without the need for an additional pan; and without the need for re-positioning the single pan that is used. Such a pan and such a coil-pan combination are very versatile as compared to prior art systems. Such a coil-pan combination and such a pan greatly simplify the installation of these systems; reduce significantly the number of different coils and different pans which an installer must inventory; and significantly reduce the time and cost of installation, particularly an installation which previously required major changes to a system's enclosure or the area in which the system was located.

In each of the orientations shown in FIGS. 15–18, air flows to the coil and then through its conditioning vanes. These system make use of the fact that the air can be conditioned whichever way it flows across the vanes, i.e.; either an outside-to-inside flow path or an inside-to-outside flow path results in conditioned (heated or cooled) air. In all four orientations a single pan is disposed beneath the coil and condensate flows by gravity to the pan in each orientation so that only one pan is required (not two). These systems also make use of the fact that with a V-coil the coil can be oriented with its V-end pointing in either of two directions. In other embodiments the general shape of the pan opening corresponds generally to the shape of the coil. In certain of the systems, a top cover plate on the coil affects the air flow path and insures that the desired path is achieved (and no second cover plate on an opposite end of the coil is used).

FIGS. 15–18 show a pan-coil combination 500 with a pan 502 (like the pan 420, FIG. 13) and a coil 504 (like the coil 440, FIG. 13). A coil closure plate 506 mounted on top of the coil 504 prevents air from flowing either out from a space 508 between two sides 510 and 512 of the coil, or into the space 508 from outside the coil, i.e., this closure plate prevents air from bypassing conditioning vanes 514 in each side of the coil 504.

As shown in FIG. 15, an upright system 520 has an enclosure 521 with a coil-pan combination 500 mounted at the top thereof adjacent an air inlet opening 522. Air flows into the opening 522; down to the sides of the coil 504; through its vanes 514; through an opening (not shown) in the pan 502 (like the opening 428 in the pan 420, FIG. 13); to a blower 523; and is then blown downwardly and out through an air outlet 524 from the enclosure 521. By making it possible for the coil-pan combination 500 to be disposed horizontally as shown in FIG. 15, an enclosure such as the enclosure 521 which might not be able to accommodate a coil-pan combination of a certain vertical height in a typical vertical coil orientation (i.e., V-point of the coil pointing upwardly) can accommodate a horizontally oriented coil of that vertical height.

Without changing the coil-pan's horizontal orientation, and without adding an additional pan, the coil-pan combination 500 can be utilized in an upflow system 530 as shown in FIG. 16. Air flows into an air inlet opening 532 in an enclosure 531 and through the opening (not shown) in the pan 502 into the space 508 in the coil-pan combination's interior. The closure plate 506 prevents the air from flowing out from the top of the coil-pan combination. Thus the air flows through the vanes 514 on both sides of the coil. The conditioned air then flows upwardly to a blower 533 which propels it out of the enclosure 531 through an air outlet opening 534.

Figure 17:
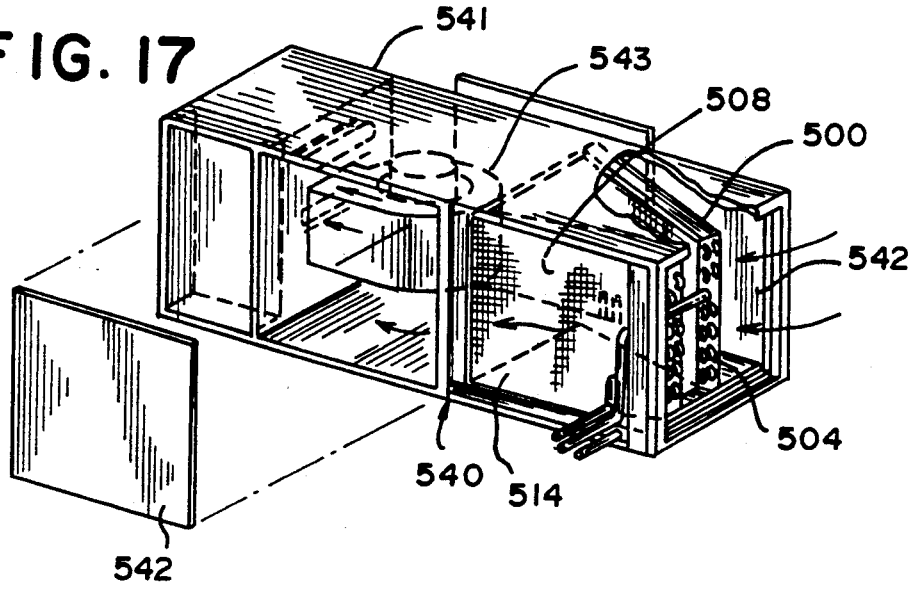

In a system 540 shown in FIG. 17, air flow is generally horizontal through the system from one end to the other (right to left as shown in the Figure). Air flows into an air inlet opening 542 in an enclosure 541 to a coil-pan combination 500. The air then flows through the vanes 514 of the coil 504 into the space 508 between the coils sides and then to a blower 543 which propels the air out from the enclosure 541. A removable side wall 542 provides access to the enclosure's interior.

Figure 18:
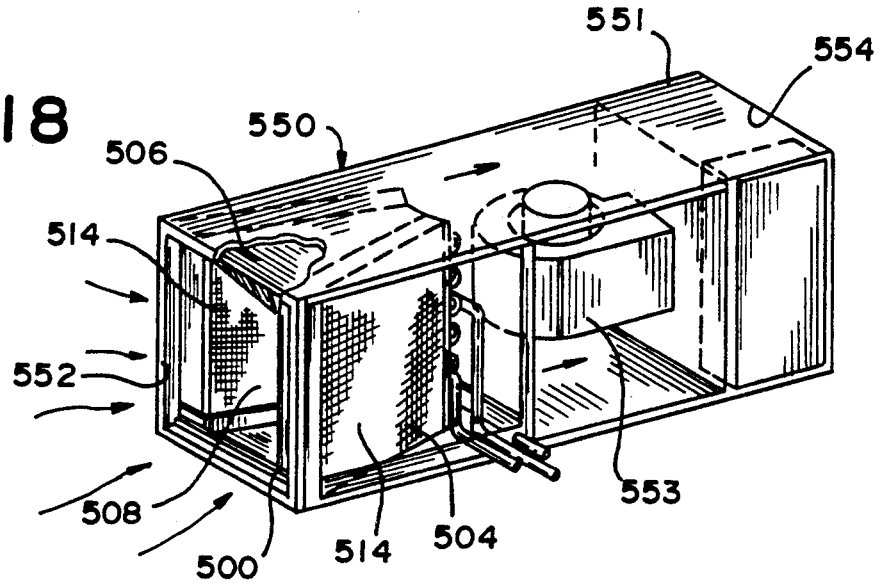

In a system 550 with an enclosure 551 shown in FIG. 18, air initially flows through an air inlet opening 552 into the space 508 of the coil 504 of the coil-pan combination 500. Due to the fit (preferably a tight fit) of the combination in the enclosure 551 and due to the closure plate 506, the air flows through the coil's vanes 514 to a blower 553 which blows the conditioned air from the enclosure 551 through an air outlet opening 554. Air flow to and through the coil 504 in the system 550 is initially into the wider base of the coil and then past its narrow V-point (as in contrast to air flow in the system 540 of FIG. 17 in which air flows from the V-point toward the wider base).

In each of the systems shown in FIGS. 15–18 it is preferred that the coil-pan combination fit tightly in the system enclosure so that substantially all of the air to be conditioned must flow across the coil's vanes rather than around the coil bypassing the vanes. These various systems also illustrate that, with a coil-pan combination according to this invention an air inlet opening may be situated in a variety of locations with respect to the various sides of the coil-pan combination.

In conclusion, therefore, it is seen that the present invention and the embodiments disclosed herein are well adapted to carry out the objectives and obtain the ends set forth at the outset. Certain changes can be made in the method and apparatus without departing from the spirit and the scope of this invention. It is realized that changes are possible and it is further intended that each element or step recited in any of the following claims is to be understood as referring to all equivalent elements or steps for accomplishing substantially the same results in substantially the same or equivalent manner. It is intended to cover the invention broadly in whatever form its principles may be utilized. The present invention is, therefore, well adapted to carry out the objects nd obtain the ends and advantages mentioned, as well as other inherent therein.

What is claimed is:

1. A device for conditioning air, the device comprising an enclosure having an interior and the enclosure having sides made of an insulative material and having a top metal member and a bottom metal member over the insulative material and an air conditioning coil with a plurality of vanes disposed in the enclosure, a first opening in the enclosure through which unconditioned air flows to the coil, air conducting means connected to the enclosure for conducting conditioned air from the enclosure, the air-conducting means comprising a plurality of at least two air-conducting conduits, at least two second openings in the enclosure to which flows air conditioned by the coil and from which air flows to the air-conducting means, one second opening corresponding to each of the at least two air-conducting conduits, the air flowing only once through the coil, the coil's vanes directing air in the general direction of the at least two second openings, a customizable connection member for connecting the first opening to an outlet of an air-conveying apparatus which conducts the unconditioned air to the first opening, the connection member comprising metal bracing members movably positionable about and securable about the first opening for accommodating the outlet of the air-conveying apparatus, a blower for moving unconditioned air to the first opening of the enclosure, the blower mounted adjacent to the air-conveying apparatus which conducts the unconditioned air to the second openings.

2. The device for conditioning air of claim 1 wherein the enclosure has at least one side made from duct board suitable for easily cutting the second openings therethrough.

3. The device of claim 1 wherein the coil is a coiling coil.

4. The device of claim 1 comprising also a drain pan comprising a body member defined by side walls and at least one bottom wall, the bottom wall having a pan opening there-through for air flow to the coil, the coil mounted on the pan and having a general shape viewed from one end, and the pan opening corresponding in shape to the general shape of the coil.

5. The device of claim 4 wherein the general shape of the coil is a V-shape and the corresponding shape of the pan opening is a general V-shape.

6. The device of claim 4 wherein the at least one bottom wall is a plurality of bottom walls and the side walls and bottom walls define a plurality of sub-pans mounted to the body member, the sub-pans spaced apart by sub-openings so that air to be conditioned flows between the sub-pans.

7. The device of claim 4 wherein the coil is comprised of sub-coils which are generally configured in an M-shape when viewed from a side thereof, the coil having three bases comprised of extending edges of sub-coils, the pan having an end trough, the plurality of sub-pans comprising three sub-pans, one sub-pan extending adjacent and beneath each of the three bases of the coil, the three sub-pans communicating with the end trough, so that water flowing into the sub-pans flows into the end trough, and the end trough having a water drain outlet.

8. An air conditioning system drain pan comprising a body member defined by side walls and a plurality of bottom walls, the bottom walls for supporting a coil mounted on the drain pan, the coil comprised of sub-coils which are generally configured in an M-shape when viewed from a side thereof, the coil having three bases comprised of extending edges of sub-coils, the pan having an end trough, the plurality of bottom walls and the side walls defining a plurality of sub-pans mounted to the body member, the sub-pans spaced apart so that air to be conditioned flows between the sub-pans to the coil, the plurality of sub-pans comprising three sub-pans, one sub-pan extending adjacent and beneath each of the three bases of the coil, the three sub-pans communicating with the end trough, so that water flowing into the sub-pans flows into the end trough, and the end trough having a water drain outlet.

* * * * *